US005211388A

United States Patent [19]

Walluk

[11] Patent Number: 5,211,388

[45] Date of Patent: May 18, 1993

[54] RETARD ROLL ENHANCEMENT

[75] Inventor: Edward L. Walluk, Fairport, N.Y.

[73] Assignee: Xerox Corporation, Stamford, Conn.

[21] Appl. No.: 892,879

[22] Filed: Jun. 3, 1992

[51] Int. Cl.[5] ..... B65H 3/46

[52] U.S. Cl. ..... 271/122; 271/125

[58] Field of Search ..... 271/121, 122, 124, 125

[56] References Cited

U.S. PATENT DOCUMENTS

| | | | |
|---|---|---|---|
| 3,469,834 | 4/1967 | Stange | 271/10 |
| 3,768,803 | 10/1973 | Stange | 271/34 |
| 3,895,791 | 7/1975 | Kramell et al. | 271/35 |
| 3,937,455 | 2/1976 | Hauser | 271/122 X |
| 3,941,373 | 3/1976 | Stange | 271/124 |
| 4,014,537 | 3/1977 | Stange | 271/166 |
| 4,043,549 | 8/1977 | Rinehart | 271/118 |
| 4,306,713 | 12/1981 | Avritt | 271/122 X |
| 4,327,904 | 5/1982 | Holmes | 271/35 |
| 4,705,265 | 11/1987 | Hirota | 271/122 |
| 4,991,831 | 2/1991 | Green | 271/125 X |

OTHER PUBLICATIONS

Xerox Disclosure Journal, vol. 8, #4, Jul./Aug. 1983, "Edge Force Sheet Separating System", by John Maksymiak, et al., pp. 315-316.

Xerox Disclosure Journal, vol. 12, #1, Jan./Feb., 1987 "Bottom Friction Retard Feeder" by William D. Milillo, p. 51.

Xerox Disclosure Journal, vol. 7, #2, Mar./Apr. 1982, "Floating Gate Sheet Separator/Feeders With Outriggers" by Dennis P. Teeter, et al., pp. 67-68.

*Primary Examiner*—Richard A. Schacher

[57] ABSTRACT

An apparatus for feeding individual sheets from the bottom of a sheet stack. The sheet stack is placed in the paper tray with the lead edge abutting the sheet feeding apparatus. The face of the stack rests against the main fang. As the feed roll forwards the sheets from the bottom of the stack to a position under the main fang, further sheet separation occurs as the lead edges of the sheets strike a substantially arcuate member located between the main fang and the retard roll. The curved portion of the member which has a larger radius of curvature than the retard member causes the sheets to be shingled out permitting a single sheet to pass under the retard roll and to be advanced by the feed roll.

11 Claims, 4 Drawing Sheets

RETARD ROLL ENHANCEMENT

Figure 1:
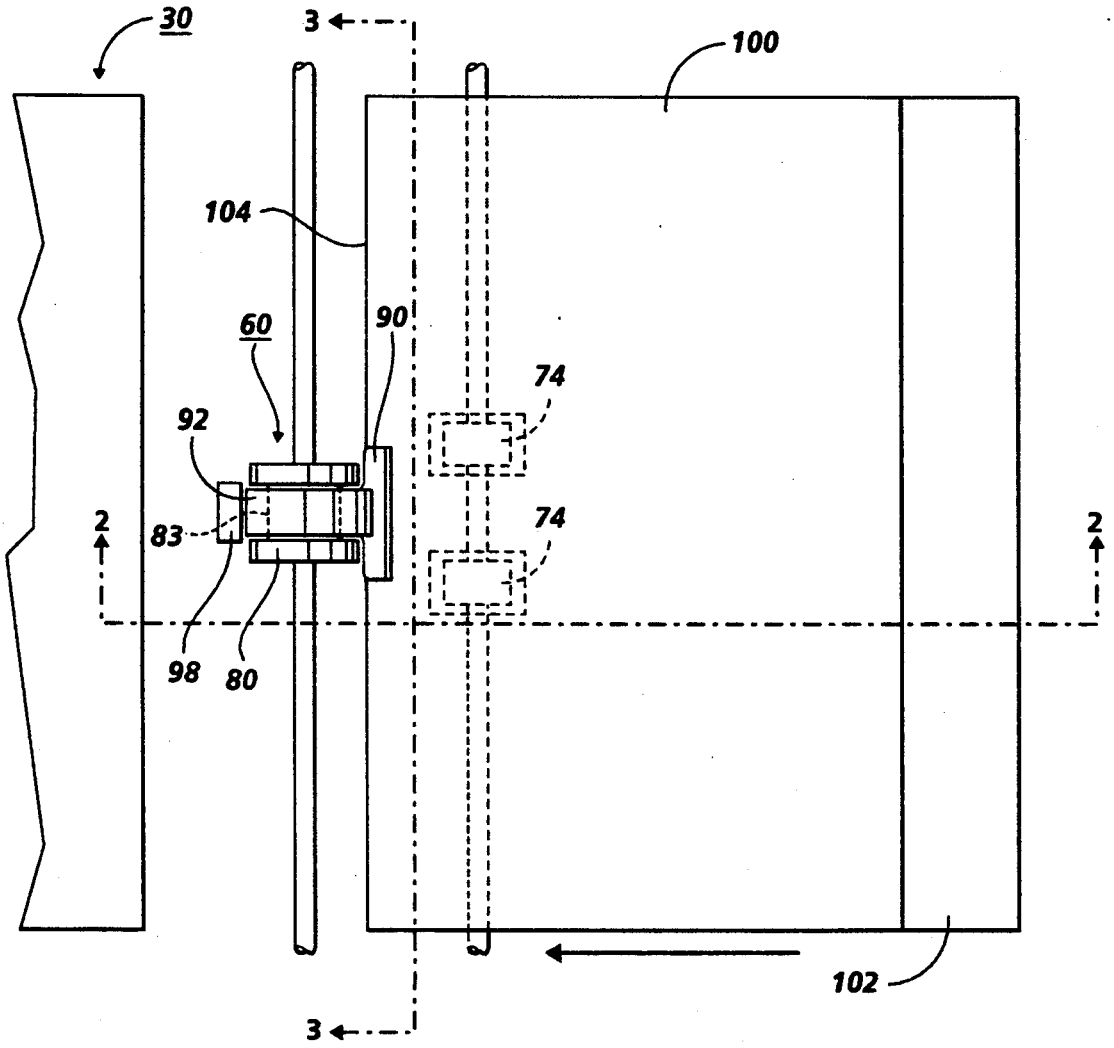

This invention relates generally to a bottom feed sheet feeding system, and more particularly concerns an improved sheet separator for preventing multi-sheet feeding from the bottom of a stack of sheets in a feeder for original documents and/or copy sheets for use in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, a sheet misfeed or multi-fed sheets can seriously impair the operation of the machine. It is advantageous in many of today's machines to provide for the in seriatim feeding of sheets from the bottom of the stack. This is useful in both recirculating document handlers for original sheets and to enable replenishment of copy sheets without interrupting machine operation for copy sheets. Due to the inherent problems of feeding from the bottom of the paper stack, many devices have been developed to attempt to alleviate the problems and prevent multi-fed sheets. Three typical problems encountered in bottom feeding sheets from a stack include (1) separating a sheet or sheets from the stack; (2) queuing the separated sheets into an order corresponding to their order in the stack; and (3) advancing the queued sheets into the sheet processing system served by the feeding device. It is also desirous to provide a retard feed device that is self-adjusting, requires little or no set-up for tight tolerances and does not allow sheets to ride up on or stub on the retard surface. The present invention improves over past systems by separating multi-feeds simply, quickly and effectively. The other problems noted with retard feed devices are also solved by the present invention. The following disclosures may be relevant to various aspects of the present invention:

U.S. Pat. No. 4,327,904; Patentee—Holmes; Issue Date: May 4, 1982.

U.S. Pat. No. 4,043,549; Patentee—Rinehart; Issue Date: Aug. 23,1977.

U.S. Pat. No. 4,014,537; Patentee—Stange; Issue Date: Mar. 29, 1977.

U.S. Pat. No. 3,895,791; Patentee—Kramell et al.; Issue Date: Jul. 22, 1975.

U.S. Pat. No. 3,941,373; Patentee—Stange; Issue Date: Mar. 2, 1976.

U.S. Pat. No. 3,768,803; Patentee—Stange; Issue Date: Oct. 30, 1973.

U.S. Pat. No. 3,469,834; Patentee—Stange; Issue Date: Sep. 30, 1969.

U.S. application Ser. No. 07/858,262; Applicant-Sheridan; Filed: Mar. 26, 1992.

*Xerox Disclosure Journal*; Vol. 8, No. 4, July/August, 1983; Pages 315 and 316.

*Xerox Disclosure Journal*; Vol. 12, No. 1, January/February, 1987; Page 51.

*Xerox Disclosure Journal*; Vol. 7, No. 2, March/April, 1982; Pages 67 and 68.

The relevant portions of the foregoing disclosures may be briefly summarized as follows:

U.S. Pat. No. 4,327,904 discloses an apparatus for selectively increasing the effective frictional force between a retard member and a feed member by making both members from conductive elastomers and providing a source of electrical potential to produce electrical potential between them. A sensor located downstream of the retard member will sense a multi-feed between the pad and retard member and effect the production of electrical potential to increase the friction between the two members.

U.S. Pat. No. 4,043,549 discloses an air flotation bottom feeder employing a whip or paddle/impact feeder to positively separate single sheets from the bottom of the sheet stack.

U.S. Pat. No. 4,014,537 describes a sheet feeding device adapted for feeding sheets from the bottom of the stack utilizing an air flotation stacking tray to minimize sheet to tray and intersheet friction.

U.S. Pat. No. 3,895,791 discloses a belt feeder in which a retard pad is biased against the belt between a pair of rollers and an in-feed chute abuts or restrains the lead edge of the stack and is sloped to slope the stack. The slope generates a normal component between the stack and belt that enhances feeding engagement.

U.S. Pat. No. 3,941,373 describes a sheet feeding device adapted to separate a single sheet from the top of a stack and utilizes a feed belt disposed adjacent to one edge of the stack and a floating gate means biased into engagement with the feed belt to provide a forward stop for the sheet stack. The top sheet is frictionally engaged by the belt and the floating biased gate means prevents multiple sheets passing through the feeding means.

U.S. Pat. No. 3,768,803 describes a top feeding device in which a feed belt is positioned against a curved retard means forming a sheet queuing throat. The belt contacts a stack of sheets near its edge and separates the sheets from the stack into the throat. The throat aligns the sheets and the belt advances the queued sheets onto the sheet handling system being served.

U.S. Pat. No. 3,469,834 again describes a top of stack sheet feeding device in which sheets are advanced into a wrap formed between a stationary retarding roll or abutment member and a moving belt surface. Multiple sheets are separated due to frictional contact with the abutment member.

U.S. application Ser. No. 07/858,262 discloses a stepped, corrugated secondary fang to shingle sheets prior to a friction retard roll.

Xerox Disclosure Journal, Vol. 8. No. 4, discloses a sheet retard member utilizing relatively stiffer materials for improved abrasion resistance and further utilizing either grooves and/or holes in the surface to enable separation.

Xerox Disclosure Journal, Vol. 12, No. 1, discloses a spring-loaded retarding device which utilizes a steep sloped ski to hold back the edge of the stack and further discloses a friction pad with a shallower taper on the bottom of the ski to shingle out the documents.

Xerox Disclosure Journal, Vol. 7, No. 2, describes a dual-gate sheet feeding device which utilizes a floating gate and additionally has integral outriggers on both sides of the regular floating stack engaging face. The outriggers serve to configure the stack face to the same angle as the floating edge gate feed means and limit the number of sheets forwarded to the floating gate.

In accordance with one aspect of the present invention, there is provided an apparatus adapted to advance sheets from a stack of sheets. The apparatus comprises means for supporting the stack of sheets and means, mounted adjacent said support means, for advancing sheets from the stack. A retard member having a substantially arcuate surface in engagement with a portion of said advancing means is also provided. Means, for queuing and separating sheets being advanced by said advancing means from the stack being supported on said support means is further provided.

Pursuant to another aspect of the present invention, there is provided an electrophotographic printing machine of the type in which a sheet is advanced from a sheet stack. The improvement comprises means for supporting the stack of sheets and means, mounted adjacent said support means, for advancing sheets from the stack. A retard member having a substantially arcuate surface in engagement with a portion of said advancing means is also provided. Means for queuing and separating sheets being advanced by said advancing means from the stack being supported on said support means is also provided.

Pursuant to still another aspect of the present invention, there is provided a module sheet feeding machine adapted to be removably positioned adjacent a sheet inlet of a printing machine. The improvement comprises means for supporting the stack of sheets and means, mounted adjacent said support means, for advancing sheets from the stack. A retard member having a substantially arcuate surface in engagement with a portion of said advancing means is also provided. Means for queuing and separating sheets being advanced by said advancing means from the stack being supported on said support means is also provided.

Figure 2:
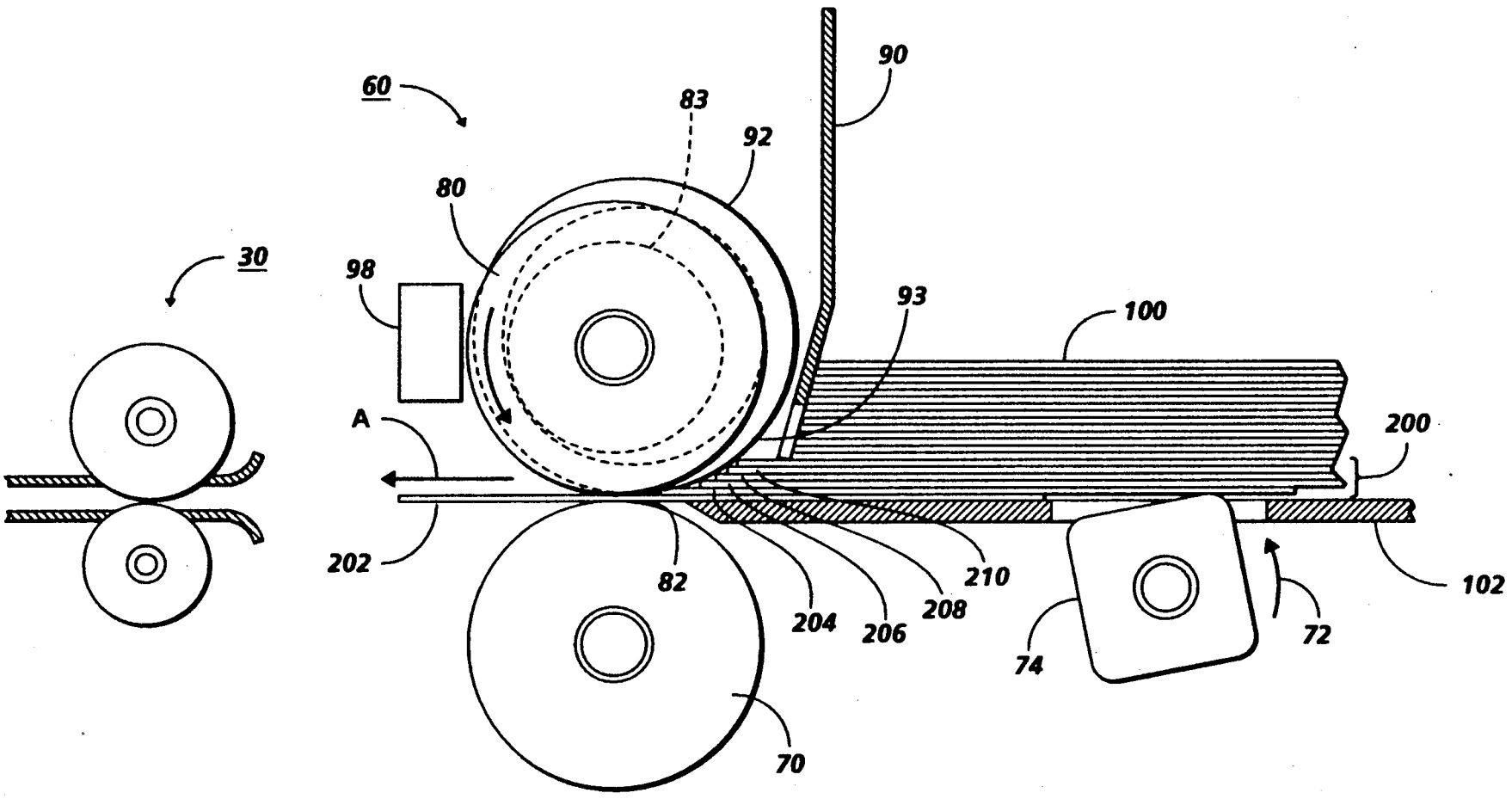
Figure 3:
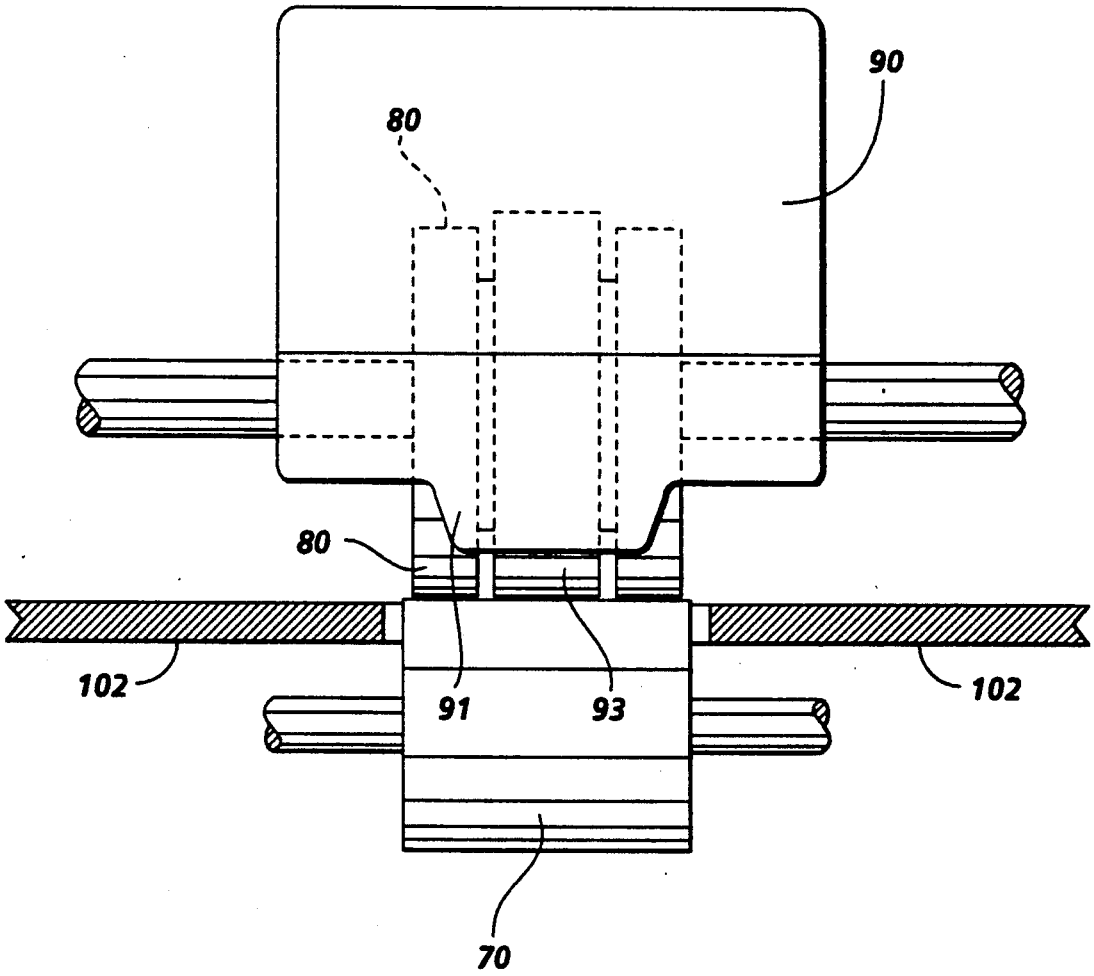
Figure 4:
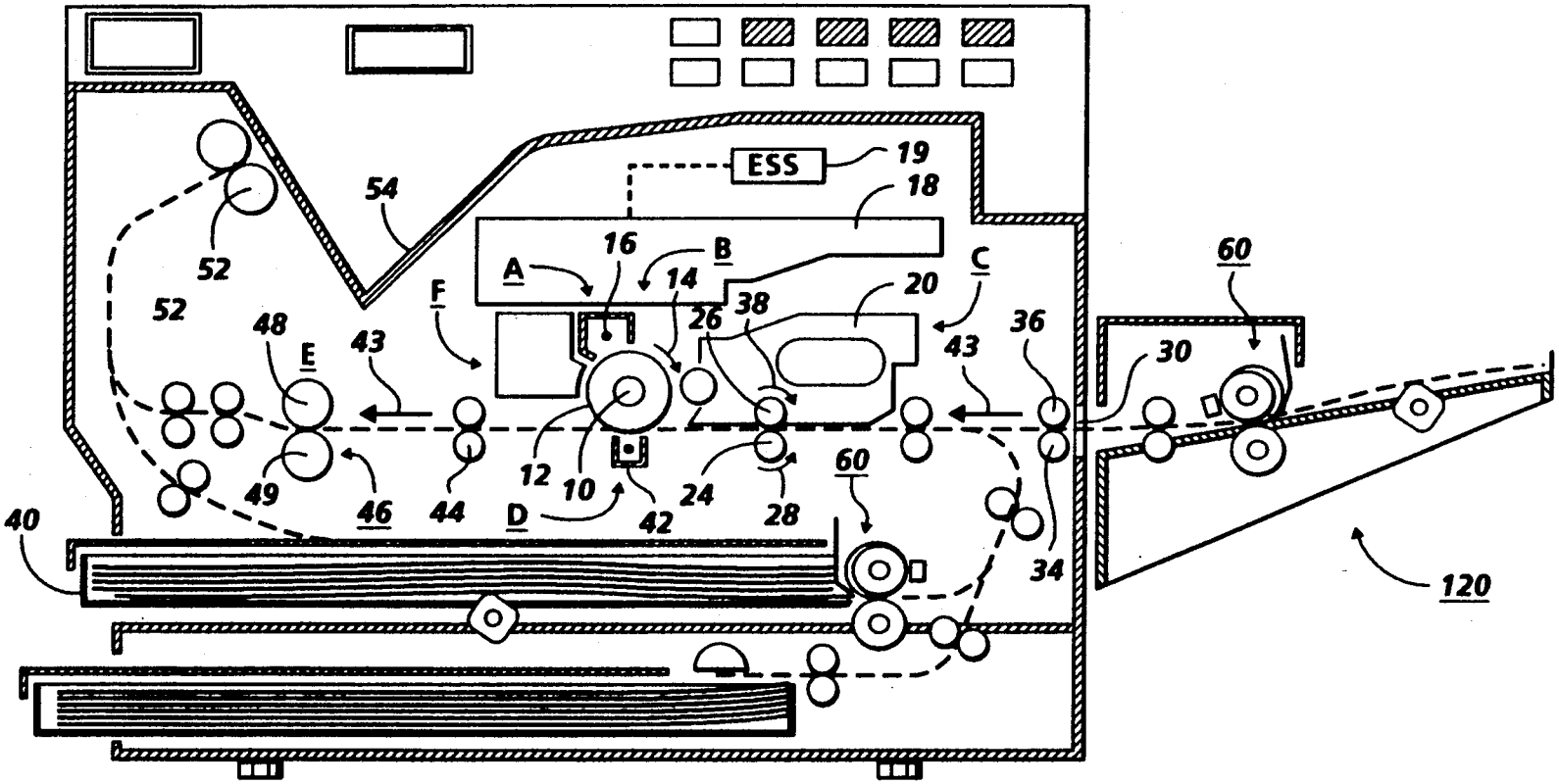

Other features of the present invention will become apparent as the following description proceeds and upon reference to the drawings, in which:

FIG. 1 is a plan view of the sheet separating device of the present invention; and FIG. 2 is an elevational view taken along the line 2—2 of FIG. 1 in the direction of the arrows; and FIG. 3 is an end view of the sheet separating device of the present invention; and FIG. 4 is a schematic elevational view depicting an illustrative electrophotographic printing machine incorporating the sheet separating apparatus of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of an electrophotographic printing machine in which the features of the present invention may be incorporated, reference is first made to FIG. 4 which depicts schematically the various components thereof. Hereinafter, like reference numerals will be employed throughout to designate identical elements. Although the sheet feeding apparatus is particularly well adapted for use in the electrophotographic printing machine of FIG. 4, it should become evident from the following discussion that it is equally well suited for use in a wide variety of devices and is not necessarily limited in this application to the particular embodiment shown herein.

Since the practice of electrophotographic printing is well known in the art, the various processing stations for producing a copy of an original document are represented in FIG. 4 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high, substantially uniform potential.

Thereafter, drum 10 rotates the charged portion of photoconductive surface 12 to exposure station B. Exposure station B includes an exposure mechanism, indicated generally by the reference numeral 18, which includes a raster output scanner (ROS) having a suitable source of high intensity light, such as laser, modulated in accordance with the content of the image data as by an acousto-optic modulator to provide zero and first order imaging beams. The imaging beam is scanned across the photoconductive surface 12 at the exposure station B by a scanning polygon to expose the previously charged photoconductive surface 12 and create a latent electrostatic image or the document represented by the image signals received from an electronic subsystem (ESS) 19.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 4, a copy sheet is advanced to the printing machine from an auxiliary, module sheet feeding machine, indicated generally by the reference numeral 120. Module sheet feeding machine 120 is adapted to be moved to a position adjacent the printing machine sheet inlet, indicated generally by the reference numeral 30. The sheet feeding machine 120 advances successive copy sheets to the printing machine for processing therein. An operator may readily remove sheet feeding machine 120 and it may be used with another printing machine. Sheet feeding machine 120 has a sheet feeding apparatus, generally indicated by the reference numeral 60 which advances the copy sheet to the machine inlet 30. Thereafter the copy sheet is advanced along the paper path by drive rolls 34 and 36 to registration roller 24 and idler roller 26. The sheet feeding apparatus 60 can also be utilized to advance sheets from an internal paper tray 40 to the registration roller 24 in an electrophotographic printing machine. Registration roller 24 is driven by a motor(not shown) in the direction of arrow 28 and idler roller 26 rotates in the direction of arrow 38 since roller 26 is in contact therewith. In operation, feed device 60 operates to advance the copy sheet from the tray through a guide along a path having rolls 34 and 36 and then into registration roller pairs 24, 26. In this way, the sheet is forwarded to drum 12 in synchronism with the developed image on the drum. The sheet is advanced in the direction of arrow 43 to transfer station D.

Continuing now with the various processing stations, transfer station D includes a corona generating device 42 which applies a spray of ions to the back side of the copy sheet. This attracts the toner powder image from photoconductive surface 12 to copy sheet. After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The residual toner particles remaining on the photoconductive surface after the transfer operation are removed from the drum 10 by a cleaning blade (not shown) in scrapping contact with the outer periphery of the drum 10 and contained within a cleaning/charging housing. Subsequent to cleaning, a discharge lamp (not shown) floods photoconductive surface 12 with light to dissipate any residual electrostatic charge remaining thereon prior to the charging thereof for the next successive imaging cycle. Alternatively, the toner particles may be mechanically cleaned from the photoconductive surface by a cleaning brush and/or blade as is well known in the art. In the embodiment illustrated, the cleaning station F and the charging station A are contained within the same removable housing.

It is believed that the foregoing description is sufficient for purposes of the present application to illustrate the general operation of an electrophotographic printing machine. Referring now to the specific subject matter of the present invention, FIGS. 1, 2 and 3 depict the sheet separating device in greater detail.

FIG. 1 illustrates a plan view of the paper tray 102 and sheet feeding apparatus indicated generally by the reference numeral 60. A sheet stack 100 to be fed into the machine is initially placed in the support tray 102. The lead edge, 104 of the sheet stack 100 rests against the main fang 90 of the sheet feeding apparatus 60. In the preferred embodiment the main fang 90 is a substantially planar element approximately 70 mm square. There is a small finger 91 located at the bottom center of the main fang 90, which is an integral part of the main fang, which finger 91 is approximately 10 mm wide by 5 mm high. The main fang 90 is mounted so that there is a space of approximately 5 mm between the bottom of the fang finger 91 and the top surface of the sheet support tray 102. A nudger 74 is located in the bottom of the support tray 102 and in combination with the feed roll 70 (FIG. 2), provides a transport means between the support tray 102 and the input portion of the electrophotographic printing machine generally indicated by the reference numeral 30. The nudger 74 is a substantially square cornered roll which rotates and contacts the bottom of the sheet stack 100. A ribbed, frictional retard roll 80 is located between the support tray 102 and the machine input 30. The retard roll 80 is mounted so that it rests upon the feed roll 70. In operation, the retard roll 80 rotates so that its tangential direction is in the opposite direction of that of the feed roll 70. When a single sheet enters the nip 82 (FIG. 2) between the feed roll 70 and the retard roll 80, the frictional force exerted on the sheet by the feed roll 70 is greater than the tangential frictional force exerted by the retard roll 80 so the sheet is forwarded to the machine input 30. If multiple sheets enter the nip 82 between the retard roll 80 and feed roll 70, the frictional force between the sheets is less than that exerted by the retard roll 80 and only the bottommost sheet, which is driven by the greater frictional force of the feed roll 70 is forwarded to the machine input 30. Any other sheets are held back by the retard roll 80 until they are driven toward the machine input 30 by the greater force of the feed roll 70.

The retard enhancement ring 92 of the present invention encircles the retard roll 80 at the ribbed portion 83, with the enhancement ring 92 having an inside diameter larger than the outside diameter of the ribbed portion 83 of the retard roll 80 to allow for some movement. The retard enhancement ring 92 encircles the retard roll 80 and extends to the main fang 90.

The operation of the retard enhancement ring 92 can best be illustrated by reference to FIG. 2. In FIG. 2, as the nudger roll 74 is driven in the direction of arrow 72, the entire sheet stack 100 initially has the lead edge 104 of the sheets come into contact with the main fang 90. The main fang 90 acts as a queuing device and allows only a small number of sheets 200 from the bottom of the stack 100 to be forwarded toward the machine input 30. As the sheets 200 continue in the direction of arrow A, the lead edges 204, 206, 208, 210 in turn contact the arcuate surface 98 of the retard enhancement ring 92, further separating and shingling the group of sheets 200. The retard enhancement ring 92 is free to move upward to a limited extent due to the inside diameter of the ring being greater than that of the ribbed portion 83 of the retard roll 80 to avoid wedging of the sheets 200. A stop 98 prevents the enhancement ring 92 from moving in the direction of paper travel (arrow A). Also, as the enhancement ring 92 is free to rotate about the rib of the retard roll 80 there is no stubbing caused by the sheets 200 contacting the ring arcuate surface 93. If multiple sheets enter the nip area, the enhancement ring 92 is free to lift to a certain extent to allow more of the retard surface to be exposed to the sheets to separate and prevent misfeeding of the sheets. Final sheet separation occurs as sheets 202, 204 reach the retard roll 80 which, as is explained previously, due to the higher coefficient of friction of the retard roll 80 to a sheet than a sheet to a sheet, prevents all but a single sheet 202 from being forwarded between the retard roll 80 and nudger roll 70 to the machine input 30. Each subsequent sheet is separated in a like manner and individually fed to the machine input 30.

The configuration of the main fang 90 can be seen most clearly in FIG. 3. The small finger 91 located at the bottom center of the main fang 90 and the resulting clearance between the bottom of the small finger 91 and the sheet support tray 102 is clearly illustrated. The enhancement ring 92 is shown encircling the ribbed portion 83 of the retard roll 80.

The retard enhancement ring 92 is preferably constructed of a non-elastomer, low-coefficient of friction material such as an acetal resin, to prevent stubbing of, and damage to, the lead edges of the sheets and to allow each sheet to be forwarded in seriatim as it is advanced. The enhancement ring 92 also prevents sheets from riding up the retard surface and being damaged thereby. Although not illustrated, it is also apparent that the separating device can be utilized to feed from the bottom of the stack in a recirculating document handler. It is further evident that the device can be adapted to separate the topmost sheet from a stack in a like manner so as to be adaptable to top feeding devices.

In recapitulation, there is provided a device for feeding individual sheets from the bottom of a sheet stack. The sheet stack is placed in the paper tray with the lead edge abutting the sheet feeding device. The face of the stack rests against the main fang which acts as an initial queuing device. As the nudger roll forwards the sheets from the bottom of the stack under the main fang, further sheet separation occurs as the lead edges of the sheets strike the arcuate surface of the retard enhancement ring located between the main fang and the retard roll. The arcuate surface presents the same or similar curvature to the sheet stack face as the retard roll and causes the sheets to be shingled out individually and only a single sheet is allowed to pass under the retard roll and to be fed by the feed roll into the machine processor.

It is, therefore, apparent that there has been provided in accordance with the present invention, a sheet separator for a bottom feed or a top feed sheet feeder that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A sheet feeding apparatus adapted to advance sheets from a stack of sheets, comprising:

means for supporting the stack of sheets;

means, mounted adjacent said support means, for advancing sheets from the stack;

a retard member having a substantially arcuate surface, said retard member comprising a ribbed elastomeric roll in circumferential contact with a portion of said advancing means so as to form a nip therebetween ; and means for queuing and separating sheets being advanced by said advancing means from the stack, said queuing and separating means comprising a substantially planar member adapted to engage a lead edge of one portion of the sheets of the stack so as to initially separate a plurality of sheets from one side of the stack and a ring having a radius of curvature greater than the arcuate surface of said retard member, said ring having an interior diameter greater than the diameter of said ribbed elastomeric roll disposed so that said ring encircles said elastomeric roll and being adapted to engage a portion of the sheets of the stack.

2. The apparatus according to claim 1, wherein said advancing means advances successive bottommost sheets from the stack being supported by said support means.

3. An apparatus according to claim 2, wherein said sheet advancing means comprises:

a nudger adapted to engage successive bottommost sheets of the stack being supported on said support means; and a feed roll in circumferential frictional contact with said ribbed elastomeric roll so as to form a drive nip therebetween to drive successive bottommost sheets of the stack.

4. An electrophotographic printing machine of the type in which a sheet is advanced from a sheet stack, wherein the improvement comprises:

means for supporting the stack of sheets;

means, mounted adjacent said support means, for advancing sheets from the stack;

a retard member having a substantially arcuate surface, said retard member comprising a ribbed elastomeric roll in circumferential contact with a portion of said advancing means so as to form a nip therebetween; and means for queuing and separating sheets being advanced by said advancing means from the stack, said queuing and separating means comprising a substantially planar member adapted to engage a lead edge of one portion of the sheets of the stack so as to initially separate a plurality of sheets from one side of the stack and a ring having a radius of curvature greater than the arcuate surface of said retard member, said ring having an interior diameter greater than the diameter of said ribbed elastomeric roll disposed so that said ring encircles said elastomeric roll and being adapted to engage a portion of the sheets of the stack.

5. The printing machine according to claim 4, wherein said advancing means advances successive bottommost sheets from the stack being supported by said support means.

6. A printing machine according to claim 5, wherein said sheet advancing means comprises:

a nudger adapted to engage successive bottommost sheets of the stack being supported on said support means; and a feed roll in circumferential frictional contact with said ribbed elastomeric roll so as to form a drive nip therebetween to drive successive bottommost sheets of the stack.

7. The printing machine of claim 4, wherein the sheet being advanced is a copy sheet.

8. The printing machine of claim 4, wherein the sheet being advanced is an original document.

9. A module sheet feeding machine adapted to be removably positioned adjacent a sheet inlet of a printing machine, comprising:

means for supporting a stack of sheets;

means, mounted adjacent said support means, for advancing sheets from the stack to the sheet inlet of the printing machine;

a retard member having a substantially arcuate surface; said retard member comprising a ribbed elastomeric roll in circumferential contact with a portion of said advancing means so as to form a nip therebetween; and means for queuing and separating sheets being advanced by said advancing means from the stack, said queuing and separating means comprising a substantially planar member adapted to engage a lead edge of one portion of the sheets of the stack so as to initially separate a plurality of sheets from one side of the stack and a ring having a radius of curvature greater than the arcuate surface of said retard member, said ring having an interior diameter greater than the diameter of said ribbed elastomeric roll disposed so that said ring encircles said elastomeric roll and being adapted to engage a portion of the sheets of the stack.

10. The printing machine according to claim 9, wherein said advancing means advances successive bottommost sheets from the stack being supported by said supported means.

11. A printing machine according to claim 10, wherein said sheet advancing means comprises:

a nudger adapted to engage successive bottommost sheets of the stack being supported on said support means; and a feed roll in circumferential frictional contact with said ribbed elastomeric roll so as to form a drive nip therebetween to drive successive bottommost sheets of the stack.

* * * * *